US008475190B2

(12) United States Patent
Sun

(10) Patent No.: US 8,475,190 B2
(45) **Date of Patent: *Jul. 2, 2013**

(54) CONNECTION UNIT FOR FLUORESCENT TUBES

(75) Inventor: Ming-Hai Sun, Hsinchu (TW)

(73) Assignee: Chuan He Co., Ltd., Hsnichu (TW)

( * ) Notice: Subject to any disclaimer, the term of this patent is extended or adjusted under 35 U.S.C. 154(b) by 215 days.

This patent is subject to a terminal disclaimer.

(21) Appl. No.: 13/067,375

(22) Filed: May 27, 2011

(65) Prior Publication Data

US 2012/0302080 A1 Nov. 29, 2012

(51) Int. Cl.
*H01R 33/02* (2006.01)

(52) U.S. Cl.
USPC ..... 439/233; 439/240

(58) Field of Classification Search
USPC ..... 439/226, 233–234, 240–241, 617, 439/699.2
See application file for complete search history.

(56) References Cited

U.S. PATENT DOCUMENTS

| | | | | |
|---|---|---|---|---|
| 2,303,156 | A * | 11/1942 | Bryant et al. | 439/232 |
| 6,769,789 | B1 * | 8/2004 | Won et al. | 362/260 |
| 6,890,199 | B2 * | 5/2005 | Vogt et al. | 439/238 |
| 7,097,327 | B1 * | 8/2006 | Barton | 362/260 |
| 7,568,930 | B2 * | 8/2009 | Brand et al. | 439/234 |
| 8,333,602 | B2 * | 12/2012 | Galluccio et al. | 439/241 |

* cited by examiner

*Primary Examiner* — Xuong Chung Trans
(74) *Attorney, Agent, or Firm* — Rosenberg, Klein & Lee

(57) ABSTRACT

A connection unit for fluorescent tubes includes a base having an extension which has an opening and an engaging portion is defined along an inner periphery of the opening, a cover is removably mounted to the base and a rotatable member is located in the cover, the cover has a terminal entrance defined in the base portion thereof so that terminals of a fluorescent tube are inserted into the terminal entrance, a shank extends from the base portion and a disk is connected to a distal end of the shank, the disk is engaged with the engaging portion of the base, the extension of the base and the cover position the disk so that the rotatable member is secured when being rotated.

5 Claims, 3 Drawing Sheets

CONNECTION UNIT FOR FLUORESCENT TUBES

BACKGROUND OF THE INVENTION

1. Field of the Invention

The present invention relates to a connection unit, and more particularly, to a connection unit with rotatable member which does not shift during rotating when the fluorescent tube is connected to the connection unit.

2. Description of Prior Art

A conventional connection unit 100 for fluorescent tubes is shown in FIGS. 4 and 5, and generally includes a rotatable member 101 which includes an opening 102 so that the terminals 201 of the fluorescent tube 200 is inserted into the connection unit 100 via the opening 102. The fluorescent tube 200 is then rotated an angle and positioned. However, when rotating the rotatable member 101, the rotatable member 101 shifts. This is because the rotatable member 101 is engaged with the connection unit 100 by its protrusion 103 at the lower end thereof so that when the fluorescent tube 200 rotates, the rotatable member 101 tends to shift and the terminals 201 may not well be in contact with the conduct plates 104 in the connection unit 100, so that the fluorescent tube 200 cannot function as expected.

The present invention intends to provide a connection unit for connecting the fluorescent tube and the rotatable member is well positioned and does not shift.

SUMMARY OF THE INVENTION

The present invention relates to a connection unit for fluorescent tubes and comprises a base having an extension which has an opening and an engaging portion is defined along an inner periphery of the opening. A cover is removably mounted to the base and a rotatable member is located in the cover. The cover has a terminal entrance defined in the base portion thereof so that terminals of a fluorescent tube are inserted into the terminal entrance. A shank extends from the base portion and a disk is connected to a distal end of the shank. The disk is engaged with the engaging portion of the base. The extension of the base and the cover position the disk so that the rotatable member is secured when being rotated.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
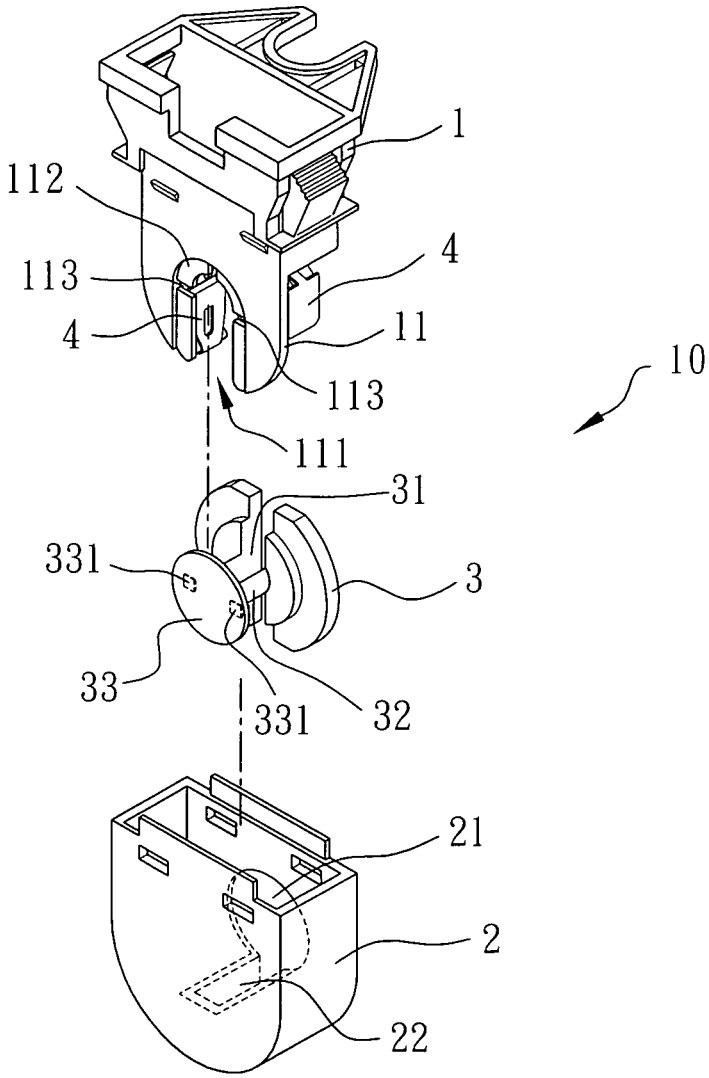
FIG. 1 is an exploded view to show the connection unit of the present invention.
Figure 2:
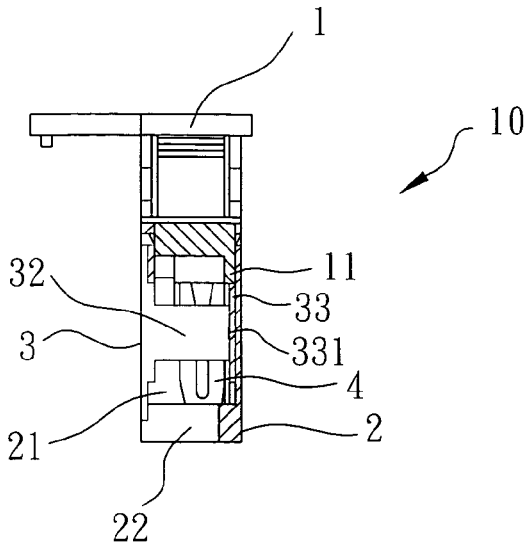
FIG. 2 is a cross sectional view to show the connection unit of the present invention.
Figure 3:
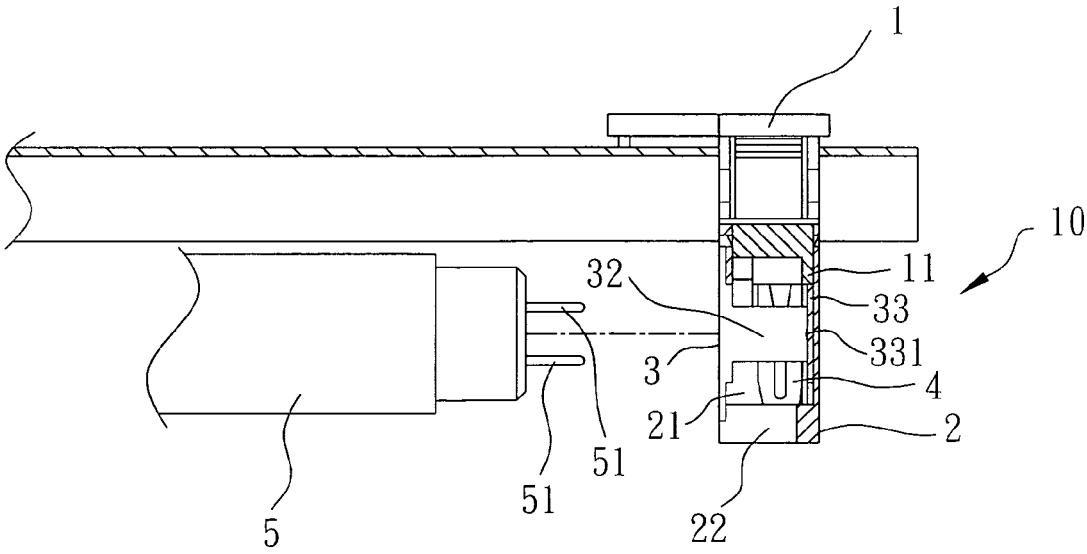
FIG. 3 is a cross sectional view to show the connection unit of the present invention and a fluorescent tube to be connected to the connection unit.
Figure 4:
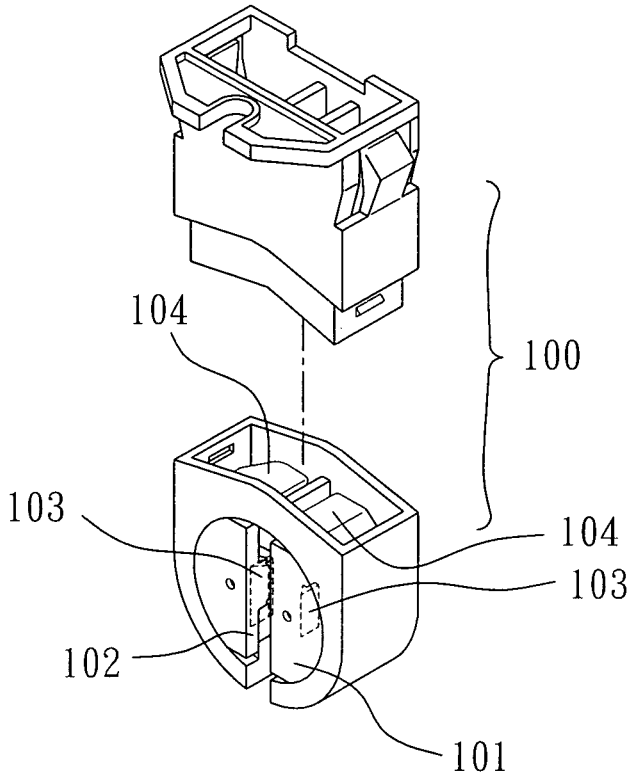
FIG.4 PRIOR ART
FIG. 4 is an exploded view to show the conventional connection unit.
Figure 5:
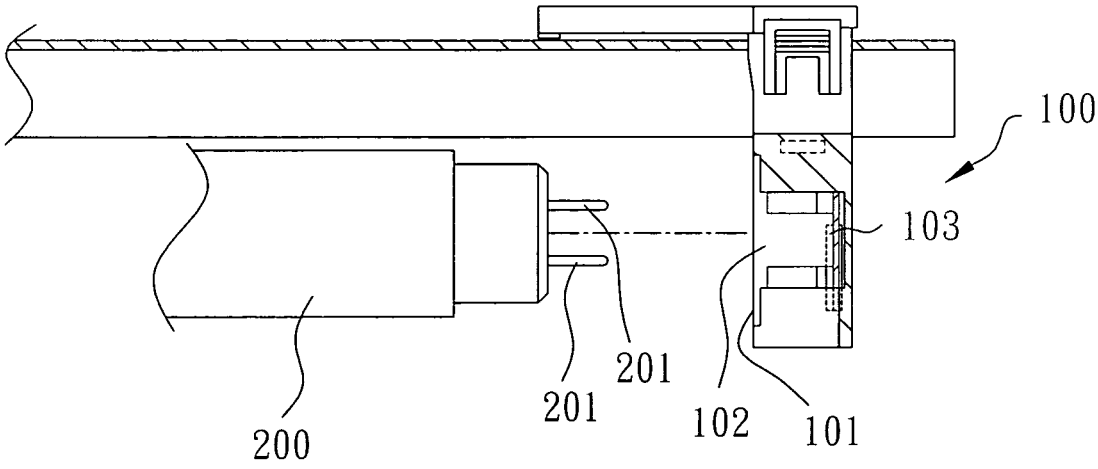
FIG.5 PRIOR ART
FIG. 5 is a cross sectional view to show the conventional connection unit and a fluorescent tube to be connected to the connection unit.

Referring to FIGS. 1 to 3, the connection unit 10 for fluorescent tubes 5 of the present invention comprises a base 1 having a conductive plate 4. A U-shaped extension 11 extends from the base 1 and has an opening 111 defined in the lower end thereof. An engaging portion 112 is defined along the inner periphery of the opening 111. In this embodiment, the engaging portion 112 is a U-shaped portion and includes a slot. A cover 2 is removably mounted to the base 1 and has reception portion 21. A slot 22 is defined in the cover 2.

A rotatable member 3 is located in the cover 2 and has a terminal entrance 31 defined in the base portion thereof so that terminals 51 of a fluorescent tube 5 are inserted into the terminal entrance 31. A shank 32 extends from the base portion and is connected to an end of the terminal entrance 31. A disk 33 is connected to the distal end of the shank 32 and engaged with the engaging portion 112. The extension 11 of the base 1 and the cover 2 position the disk 33 so that the rotatable member 3 is secured.

The engaging portion 112 includes two positioning holes 113 on two insides thereof and the disk 33 includes two bosses 331. When the rotatable member 3 is rotated to the horizontal portion, the bosses 331 are engaged with the holes 113 to position the rotatable member 3, such that the rotatable member 3 is well positioned and does not overly rotated.

When the rotatable member 3 is located at its initial position, the terminal entrance 31 is parallel to the slot 22, and the terminals 51 of the fluorescent tube 5 are inserted into the rotatable member 3 via the terminal entrance 31. The fluorescent tube 5 is then rotated an angle to rotate the rotatable member 3, the disk 33 is rotated in the engaging portion 112, and the extension 11 and the cover 2 clamp the disk 33. When the bosses 331 are engaged with the positioning holes 113, the rotatable member 3 does not shift. When the rotatable member 3 is rotated, the terminals 51 of the fluorescent tube 5 are ensured to be in contact with the conductive plate 4. The rotatable member 3 is guided and rotated in the slot of the engaging portion 112 so that the rotatable member 3 is rotated in a stable status.

While we have shown and described the embodiment in accordance with the present invention, it should be clear to those skilled in the art that further embodiments may be made without departing from the scope of the present invention.

What is claimed is:

1. A connection unit for fluorescent tubes, comprising:

a base having a conductive plate, an extension extending from the base and having an opening, an engaging portion defined along an inner periphery of the opening;

a cover removably mounted to the base, and a rotatable member located in the cover and having a terminal entrance defined in a base portion thereof so that terminals of a fluorescent tube are inserted into the terminal entrance, a shank extending from the base portion and connected to an end of the terminal entrance, a disk connected to a distal end of the shank and engaged with the engaging portion, the extension of the base and the cover positioning the disk so that the rotatable member is secured.

2. The connection unit as claimed in claim 1, wherein the engaging portion includes two positioning holes on two insides thereof.

3. The connection unit as claimed in claim 1, wherein the engaging portion is a U-shaped portion.

4. The connection unit as claimed in claim 2, wherein the disk includes two bosses which are engaged with the holes to position the rotatable member.

5. The connection unit as claimed in claim 1, wherein the engaging portion is a slot with which the disk is engaged.

* * * * *